United States Patent [19]

Barsk

[11] Patent Number: 4,786,242

[45] Date of Patent: Nov. 22, 1988

[54] APPARATUS FOR THE CASTING OF HOLLOW SLABS OUT OF CONCRETE

[75] Inventor: Jaakko O. Barsk, Tampere, Finland

[73] Assignee: Oy Partek AB, Toijala, Finland

[21] Appl. No.: 870,026

[22] Filed: Jun. 3, 1986

Related U.S. Application Data

[62] Division of Ser. No. 607,135, May 4, 1984, Pat. No. 4,608,216.

[30] Foreign Application Priority Data

May 9, 1983 [FI] Finland ..... 83 1606

[51] Int. Cl.[4] ..... B28B 1/00

[52] U.S. Cl. ..... 425/63; 425/426; 425/427

[58] Field of Search ..... 425/64, 432, 467, 426, 425/224, 114, 427, 219, 262, 200, 62, 63

[56] References Cited

U.S. PATENT DOCUMENTS

| | | | |
|---|---|---|---|
| 3,143,781 | 8/1964 | Kalns | 425/432 |
| 3,159,897 | 12/1964 | Ellis et al. | 425/427 |
| 3,284,867 | 11/1966 | Booth | 425/114 |
| 3,587,281 | 6/1968 | Lemelson | 425/167 |
| 3,647,308 | 2/1972 | Yost | 425/219 |
| 3,877,860 | 4/1975 | Putti | 425/64 |
| 3,944,641 | 3/1976 | Lemelson | 425/167 |
| 4,022,556 | 5/1977 | Goetjen | 425/219 |
| 4,046,848 | 9/1977 | Putti | 425/64 |
| 4,330,242 | 5/1982 | Putti | 425/224 |
| 4,539,165 | 9/1985 | Paakkinen | 264/23 |
| 4,545,946 | 10/1985 | Sarja | 264/70 |
| 4,568,503 | 2/1986 | Laiue et al. | 425/426 |
| 4,574,064 | 3/1986 | Paakkinen | 264/70 |
| 4,608,216 | 8/1986 | Barsk | 264/70 |

*Primary Examiner*—Jay H. Woo
*Assistant Examiner*—C. Scott Bushey
*Attorney, Agent, or Firm*—Burns, Doane, Swecker & Mathis

[57] ABSTRACT

A casting apparatus for casting a hollow slab out of concrete includes a feeder member having an axis extending between first and second ends thereof and a forming member supported on the apparatus adjacent the second end of the feeder member. A central longitudinal axis of the feeder member is moved at a first end thereof along a path of movement of a set shape and a point of the axis of the forming member is maintained in a stationary position relative to the axis of the feeder member.

12 Claims, 7 Drawing Sheets

APPARATUS FOR THE CASTING OF HOLLOW SLABS OUT OF CONCRETE

This application is a division of application Ser. No. 607,135, filed May 4, 1984, now U.S. Pat. No. 4,608,216.

FIELD OF THE INVENTION

The present invention is concerned with a method for the casting of hollow slabs out of concrete by slide-casting, whereat concrete mix is extruded onto a base by using one or several forming members forming the cavities and the mix is compacted by moving the forming member. The invention is also concerned with a slide-casting machine for casting hollow slabs out of concrete, which device comprises a deck plate, side walls, one or several feeder members for feeding the concrete mix, as well as one or several movable forming members for forming the cavities. The invention is in particular suitable for the production of prestressed hollow slabs. It may also be applied to the manufacture of hollow slabs of reinforced concrete.

BACKGROUND OF THE INVENTION

Several slide-casting machines for hollow slabs are known in prior art, which are of a similar principle as compared with each other and in which the concrete mix is extruded in the machine by means of spiral screws. The machine runs along rails placed on the base. The spiral screw is of conical shape with the cone expanding towards the final end, whereby an efficient compacting of the concrete is also achieved.

Immediately as an extension of the spiral screw, there is a shaping member, i.e. a so-called cavity mandrel, which is vibrated by means of a vibrator fitted inside the mandrel. Moreover, a vibrator beam fitted in the deck portion of the machine is vibrated, wherein the vibration of the cavity mandrels together with the surface vibration at the top of the machine produces an ultimate compacting of the concrete.

The shaping member is typically provided for forming a cavity of circular cross-sectional shape. However, it is also known to form the cavity in any of several non-circular cross-sectional shapes. Such an apparatus is shown in U.S. Pat. No. 3,877,860, to Putti.

The cavity mandrel is followed by a so-called follower tube, whose function is to support the cavity wall at the final end of the machine.

Drawbacks of the cavity mandrel are the strong noise (higher than 85 dBA) resulting from the high vibration frequency, the high power requirement, and the low efficiency of the vibration power used for the vibration.

SUMMARY OF THE INVENTION

By means of the present invention, the prior-art cavity vibration is replaced by using a compacting apparatus and process suitable for compacting a soil-moist concrete mix.

The method in accordance with the present invention is characterized in that one end or both ends of the forming member are moved along a path of movement of desired shape. Most appropriately, one point of the longitudinal axis of the forming member maintains its position relative its support member. The slide-casting machine in accordance with the invention is characterized in that one end or both ends of the forming member can be moved along a path of movement of desired shape. The forming member may be attached to its support shaft by means of a universal-joint fastening.

In front of each forming member, there may be a screw spiral as the feeder member. Most appropriately, at least the initial end of the mandrel is moved. Within the path of movement of the initial end of the cavity mandrel, the stroke length of the mandrel is a few millimetres. At the same time, the mandrel may additionally either revolve around its longitudinal axis, or it may not revolve. The path of movement of the end of the mandrel may be of circular shape, but it may also be of some other shape, e.g. square.

When a mandrel revolving around its longitudinal axis is used, usually, cavities of circular section are produced in the hollow slabs. When the mandrel does not revolve around its longitudinal axis, the cross-sectional form of the mandrel may also be different from circular. In this way, the cavities can be shaped as desired. Even when a revolving mandrel is used, according to the present invention, it is possible to produce cavities of a sectional form different from circular if the path of movement of the end of the mandrel is not circular.

Advantages of the method in accordance with the invention are:

- essentially lower noise level as compared with cavity vibrators whose vibration frequency is 150 to 250 Hz;
- owing to the wide path of movement of the end of the mandrel next to the spiral screw, the compacting process of the concrete can be shifted from the area of the screws to the area of the mandrel.

BRIEF DESCRIPTION OF THE DRAWING

The invention and its details will be described in more detail in the following with reference to the attached drawings, wherein.

DETAILED DESCRIPTION OF THE PREFERRED EMBODIMENT

Figure 1:
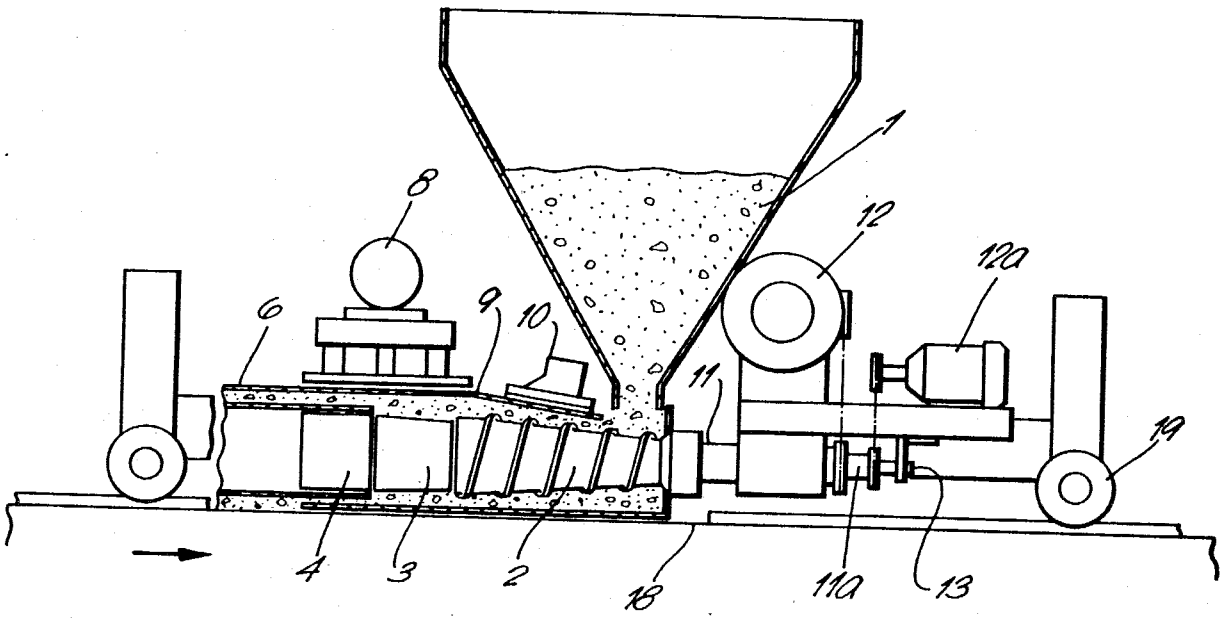
FIG. 1 is a longitudinal sectional view of a slide-casting machine in accordance with the invention.
Figure 2:
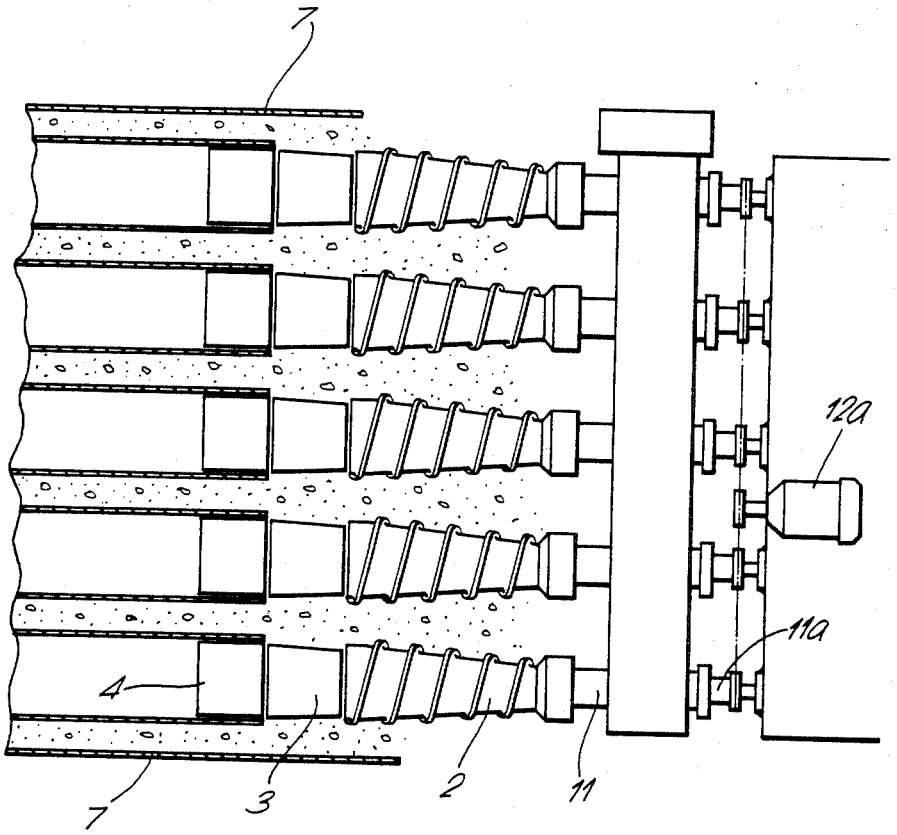
FIG. 2 shows the same machine as viewed from above and as a section.

The feeding funnel 1 is connected to the initial end of the slide-casting machine or apparatus. Depending on the size of the slab to be cast, the apparatus comprises 3 to 8 spiral screws 2, which are in such a way conical that they expand towards the final end of the machine. After the spiral screw 2, a cavity mandrel 3 is fitted, which is followed by a follower tube 4. The device additionally comprises a deck plane 6 and side boards 7. A vibrator 8 is fitted above the deck plane 6. The position of the initial end 9 of the deck plane can be adjusted by means of a front rib 10.

Each screw 2 is attached to a shaft 11, which is driven by means of a motor 12. The shaft 11*a* extends through the screw up to the initial end of the cavity mandrel 3, and it is driven by the motor 12*a*. The machine moves on the base 18 as supported on wheels 19 in the direction indicated by an arrow.

Figure 3:
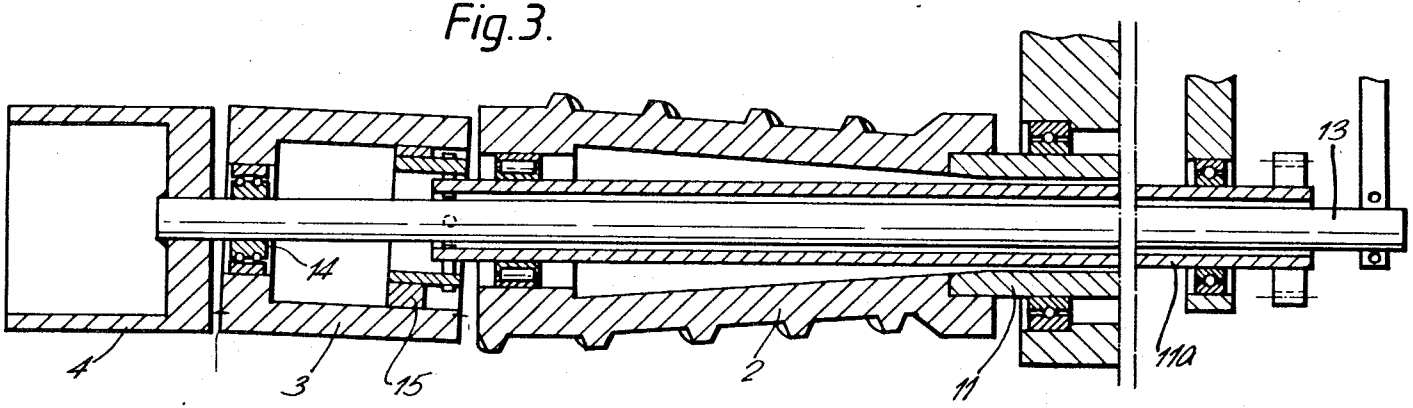
FIG. 3 is an enlarged view of a detail of one embodiment, whereat the cavity mandrel revolves around its axis.

In the embodiment shown in FIG. 3, the cavity mandrel 3 revolves on the support shaft 13 passing through the drive shaft 11*a* of the mandrel. The fastening 15 of the inital end of the cavity mandrel on the shaft 11*a* is eccentric, wherein the mandrel moves as supported on a bearing joint 14 while the shaft 11*a* revolves. Thereby the initial end of the centre center axis of the mandrel 3 moves along a circle around the centre center axis of the screw spiral 2. The face on which the initial end moves is a spherical face whose centre center point is the joint 14. The shape of the cavity mandrel may be a cone widening towards the final end, in which case the cavity formed by it is of circular cross-section.

Figure 4:
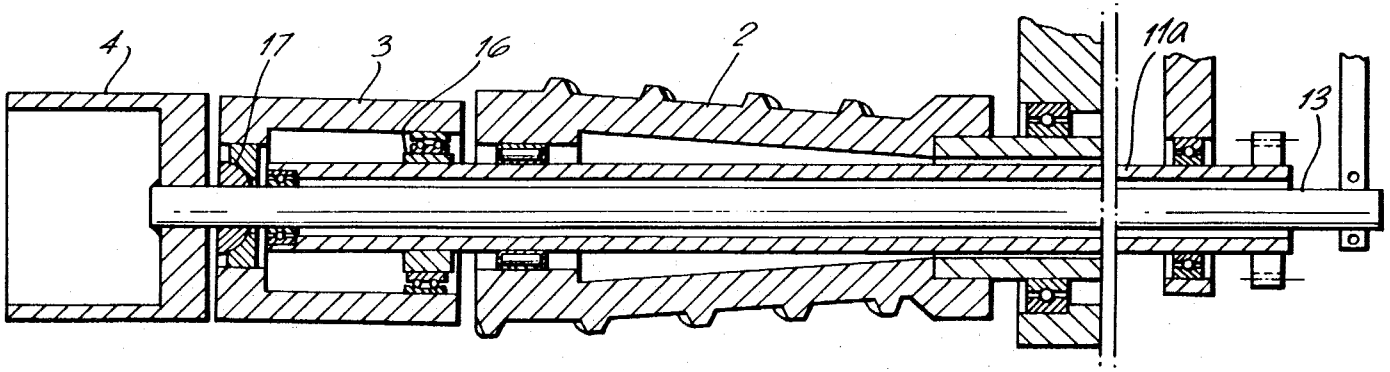
FIG. 4 shows a detail of a second embodiment, whereat the cavity mandrel does not revolve around its axis.

In the embodiment in accordance with FIG. 4, the initial end of the cavity mandrel 3 is journalled on the drive shaft 11*a* by means of an eccentric bearing 16 and its final end is attached to the shaft 13 by means of a ball joint 17. The mandrel 3 does not revolve around its own axis. When the shaft 11*a* revolves, the eccentric journalling 16 causes the initial end of the center axis of the mandrel 3 to move along a circle passing around the center axis of the screw spiral.

Figure 5:
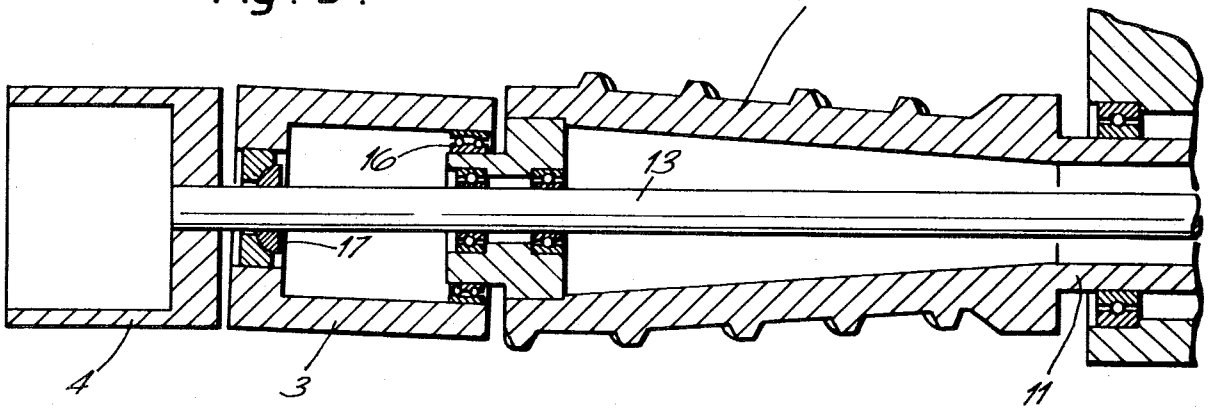
FIG. 5 shows a detail of a third embodiment, whereat the spiral screw rotates the end of the cavity mandrel.

FIG. 5 shows an embodiment in which the initial end of the mandrel 3 is attached to the final end of the spiral screw 2 eccentrically by means of the bearing 16. The final end of the mandrel is attached to the shaft 13 by means of a ball joint 17. As the screw 2 revolves, its movement of rotation is transferred and converted to a movement of the mandrel mounted to the end of the screw so that the initial end of the center axis of the mandrel again circulates around the center axis of the screw.

Figure 6:
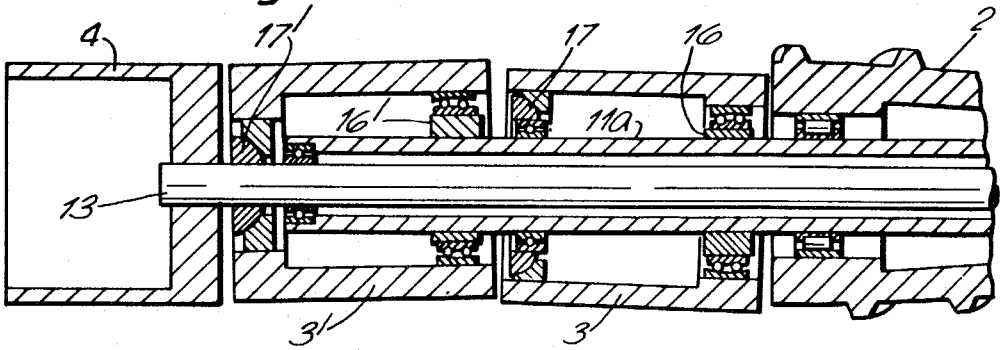
FIG. 6 shows a detail of an embodiment in which the cavity mandrel consists of two parts placed one after the other.

In the embodiment in accordance with FIG. 6, two cavity mandrels 3 and 3' are used, which are fitted one after the other and which are, at their final ends, attached to the shafts 11*a* and 13 by means of ball joints 17 and 17'. The initial ends of the mandrels are attached to the shaft 11a eccentrically by means of bearings 16 and 16'. The path of movement of the mandrel 3 closer to the initial end is somewhat wider than that of the mandrel 3' closer to the final end. Moreover, the radius of the ball face of the ball joint 17 closer to the initial end is larger than the radius of the ball joint 17', whereat the center point of the swinging movement is outside the mandrel.

The movement of the initial end of the mandrel 3 may also be produced by means of various mechanisms of path of movement in themselves known. When the mandrel 3 does not revolve, its end next to the follower tube may also have a cross-section different from a circular cavity. In such a case, the end next to the screw may be circular or slightly shaped so as to correspond to the cavity.

Figure 7A:
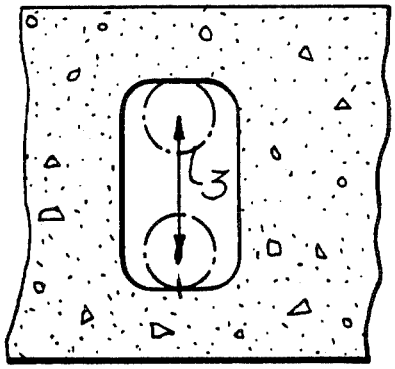
FIGS. 7*a* and 7*b* show different paths of movement of the cavity mandrel.
Figure 7B:
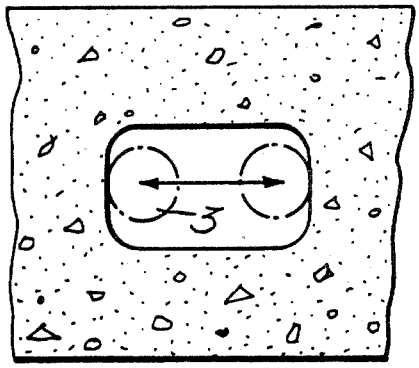

FIG. 7 shows how different cavity forms can be obtained by using different paths of movement. The path of movement may be, e.g. square or triangular. The movement may also be horizontal or vertical movement taking place back and forth along a straight line.

The mandrel may be either cylindrical or conical, in which case circular cavities are obtained. When a mandrel is used whose section is not circular, a cross-section of a cavity shaped in a corresponding way is obtained.

Figure 8A:
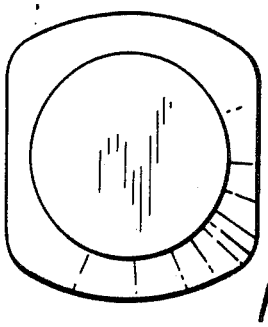
FIGS. 8*a* to 8*c* show an example on the shaping of the mandrel.
Figure 8B:
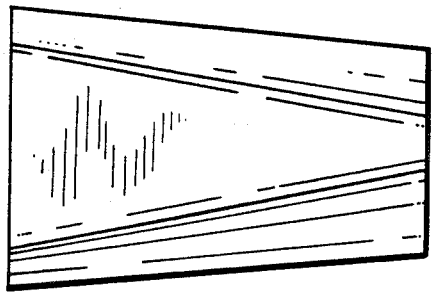
Figure 8C:
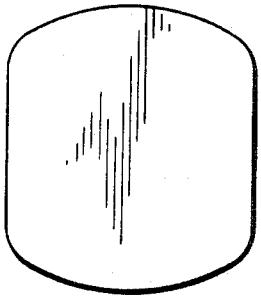

FIGS. 8*a* to 8*c* show an example on the shaping of the mandrel. FIG. 8*a* shows a circular section of the initial end of the mandrel. FIG. 8*b* is a side view of the mandrel. FIG. 8*c* is a sectional view of the final end of the mandrel.

It is also possible to place the ball joint so that the final end of the cavity mandrel moves while the initial end also moves, or that only the final end of the mandrel moves.

While this invention has been illustrated and described in accordance with a preferred embodiment, it is recognized that variations and changes may be made, and equivalents employed herein without department from the invention as set forth in the claims.

What is claimed is:

1. A casting apparatus for casting a hollow slab out of concrete, comprising:

walls;

at least one feeder member having a first end, a second end and a central longitudinal axis extending between said first and second ends of said feeder member;

a forming member having a first end, a second end and a central longitudinal axis extending between said first and second ends of said forming member, and being supported on the machine adjacent said second end of said feeder member, the feeder member being adapted to feed concrete mix toward the forming member;

means for moving said central longitudinal axis of said forming member at said first end thereof along a path of movement of a set shape;

means for maintaining a point of said central longitudinal axis of said forming member in a stationary position relative to the longitudinal axis of said feeder member; and means for moving the casting apparatus relative to the concrete mix fed to the forming member.

2. A casting apparatus as claimed in claim 1, further comprising a support shaft coaxial with the longitudinal axis and means for fastening said forming member to said support shaft, said fastening means including a universal joint fastener.

3. A casting apparatus as claimed in claim 2, wherein the forming member is of a shape having a circular cross section.

4. A casting apparatus as claimed in claim 3, wherein at least two forming members are relatively movable by a universal joint, the forming members being fitted in series.

5. A casting apparatus as claimed in claim 3, wherein the feeder member includes a revolving screw spiral at said first end of the forming member, said first end of the forming member being journalled eccentrically on a second end of the screw spiral.

6. A casting apparatus as claimed in claim 2, wherein at least two forming members are relatively movable by a universal joint, the forming members being fitted in series.

7. A casting apparatus as claimed in claim 6, wherein the feeder member includes a revolving screw spiral at said first end of the forming member, said first end of the forming member being journalled eccentrically on a second end of the screw spiral.

8. A casting apparatus as claimed in claim 2, wherein the feeder member includes a revolving screw spiral at said first end of the forming member, said first end of the forming member being journalled eccentrically on a second end of the screw spiral.

9. A casting apparatus as claimed in claim 2, further comprising means for rotating said forming member around said central longitudinal axis.

10. A casting apparatus as claimed in claim 9, wherein the forming member is of a shape having a circular cross section.

11. A casting apparatus as claimed in claim 9, wherein at least two forming members are relatively movable by a universal joint, the forming members being fitted in series.

12. A casting apparatus as claimed in claim 9, wherein the feeder member includes a revolving screw spiral at said first end of the forming member, said first end of the forming member being journalled eccentrically on a second end of the screw spiral.

* * * * *